United States Patent [19]

Schmidt et al.

[11] Patent Number: 4,524,048

[45] Date of Patent: Jun. 18, 1985

[54] APPARATUS FOR COMPACTING BIOINJURIOUS WASTES

[75] Inventors: Gerhard Schmidt, Linsengericht; Walter Kohlpoth, Offenbach, both of Fed. Rep. of Germany

[73] Assignee: Nukem GmbH, Hanau, Fed. Rep. of Germany

[21] Appl. No.: 443,892

[22] Filed: Nov. 23, 1982

[30] Foreign Application Priority Data

Nov. 25, 1981 [DE] Fed. Rep. of Germany ..... 3146592

[51] Int. Cl.[3] ..... G21F 9/34; G21F 9/36

[52] U.S. Cl. ..... 422/159; 100/218; 100/223; 100/902; 252/626; 252/633; 422/117

[58] Field of Search ..... 422/159, 117, 5, 28; 100/218, 223, 902; 252/626, 633; 141/71; 264/0.5; 427/5, 6

[56] References Cited

U.S. PATENT DOCUMENTS 4,008,658 2/1977 Stock et al. ..... 422/159 X

FOREIGN PATENT DOCUMENTS 1908019 9/1970 Fed. Rep. of Germany ..... 252/626
2243136 3/1974 Fed. Rep. of Germany .
2659691 12/1976 Fed. Rep. of Germany .

*Primary Examiner*—Barry Richman
*Assistant Examiner*—William R. Johnson
*Attorney, Agent, or Firm*—Cushman, Darby & Cushman

[57] ABSTRACT

Plants are used for the reduction in volume of solid, bioinjurious wastes, especially radioactive wastes, in closed sheet metal containers, which consist of a closed containment enclosure having roller conveyors and other transportation elements, a container receiving lock, a high pressure press and a container discharge lock; a compacting apparatus is characterized by a container charging lock rotatable around the vertical axis and having a hydraulic cylinder for transporting the sheet metal container into the high pressure press and having a hydraulic for ejecting the shaped sheet metal container whereby a movable gripping element takes charge of transportation of the formed sheet metal container to the container discharge point.

17 Claims, 3 Drawing Figures

APPARATUS FOR COMPACTING BIOINJURIOUS WASTES

BACKGROUND OF THE INVENTION

The present invention is directed to an apparatus for compacting solid bioinjurious wastes, especially radioactive waste, in closed sheet metal containers, consisting of a closed containment having roller conveyors and other transportation elements, a container entrance lock, a high pressure press and a container discharge lock with a collecting vessel.

In the elimination of solid, bioinjurious wastes, especially with solid radioactive wastes, there is the problem of concentrating the waste volumes to such an extent that the least possible waste volume is obtained without releasing the toxic or radioactive constituents in the handling or storage. This type of solid waste, which is to be treated, is derived from the chemical industry, the petrochemical industry, the medicinal and pharmacy sector, from research places, hospitals and from the nuclear installations.

There are used to compact the waste volumes, e.g., packing presses, which compress the solid goods, in part directly in waste containers, for example in 200 liter drums. Such compacting devices are described for example in German No. OS 26 59 691, in German Pat. No. 22 43 136 and in the Chemie-Ing. Techn., 42nd year, 1970, No. 9/10, pages 649 and 650. There are also known high pressure presses with which waste containers are compacted together with their waste contents.

All of these compacting devices have in part the disadvantages of the extensive exposed supplying and handling of the waste, and also the disadvantage of a very expensive design. Therefore, such plants are little suited for a variable quick insertion or loading at waste collection places and in the regular removal in the chemical and nuclear industry.

The present invention, therefore, is based on the problem of providing an apparatus for compacting solid bioinjurious wastes, especially radioactive wastes, located in closed sheet metal containers consisting of a closed containment area having roller conveyors and other transportation elements, a container inlet entrance lock, a high pressure press and a container discharge lock with a collecting vessel, which is completely safe for the environment and in a given case can be loaded quickly, as well as being simple and safe to handle and is connectable to the supply devices for the solidification agent which is used at times.

SUMMARY OF THE INVENTION

The present invention solves this problem by providing a compacting apparatus having a closed chamber provided with a container receiving or entrance lock which is rotatable about a vertical axis and having a hydraulic cylinder for transporting the metal container into the high pressure press and having a hydraulic cylinder for moving and ejecting the shaped metal containers out of the high pressure press and in the normal position lying within the roller conveyor, and having arranged above the container discharge lock a movable gripping element for the shaped metal container.

In an advantageous development the containment chamber is provided with a conduit or connection for supplying solidification agent. It is possible via this connection to convey solidifying agent into the initial or final storage container containing the shaped metal container.

DETAILED DESCRIPTION OF THE DRAWINGS

Figure 1:
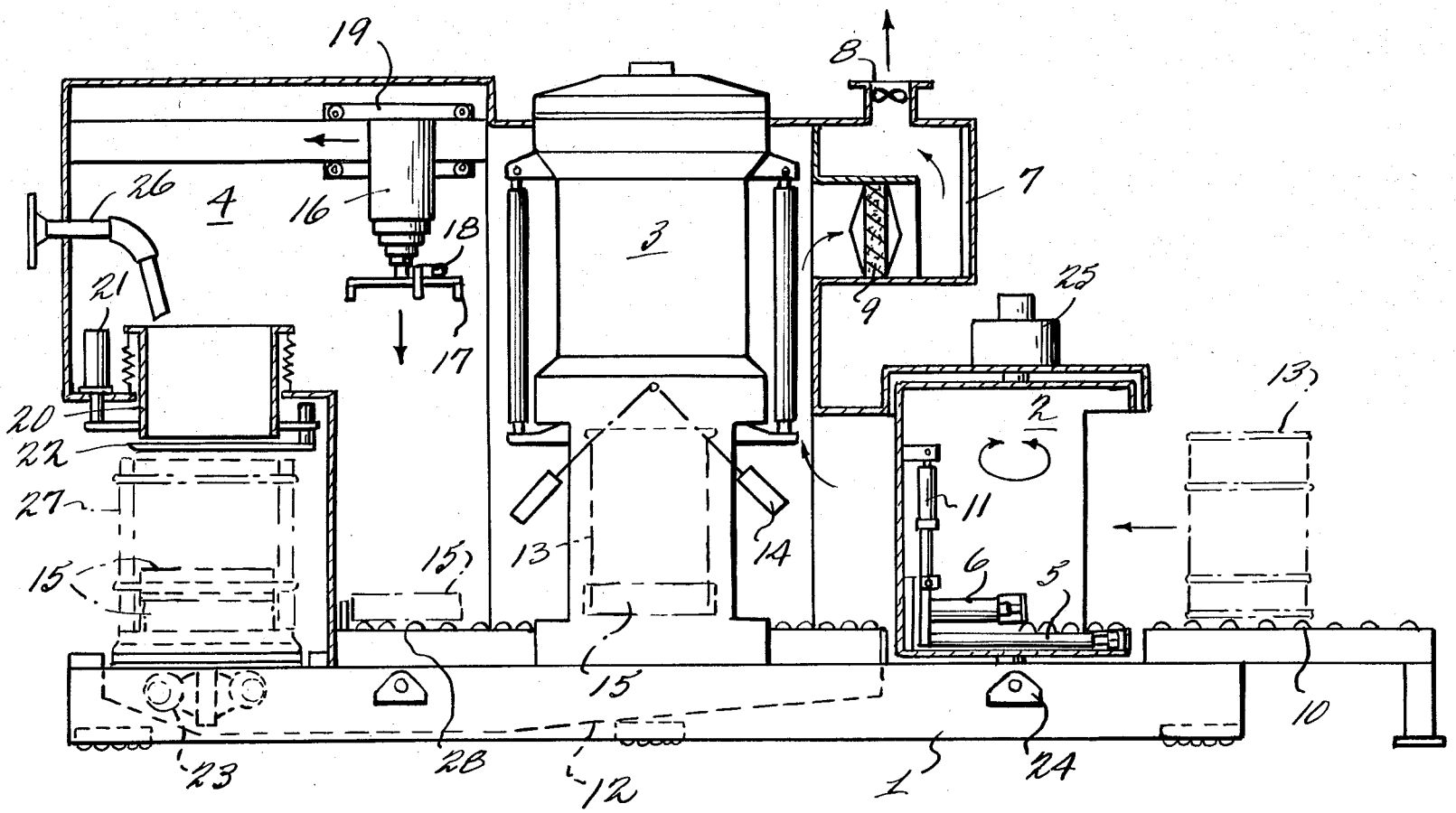
FIG. 1 schematically shows an advantageous form of the apparatus of the present invention.
Figure 2:
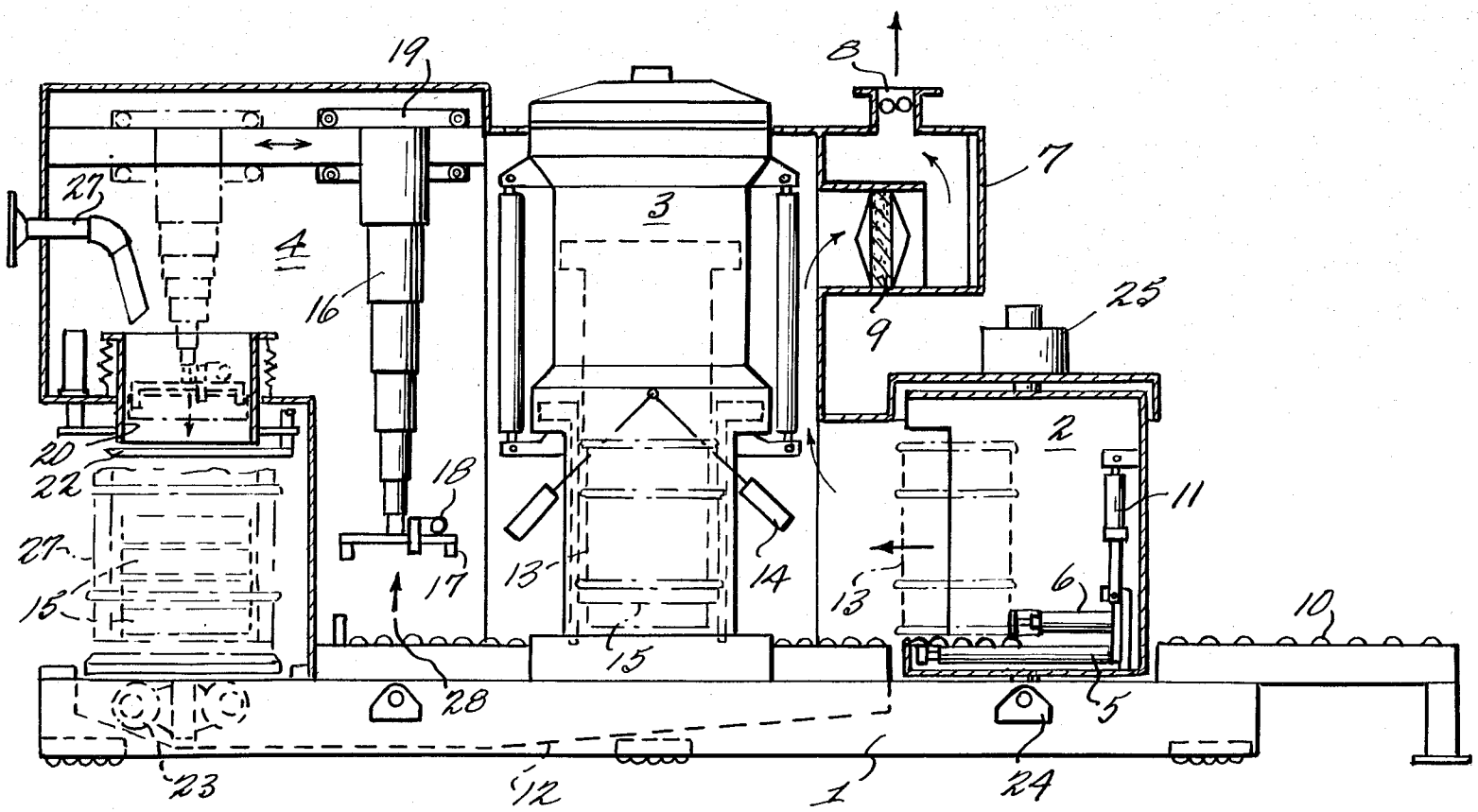
FIG. 2 schematically shows another condition and details of the apparatus of the present invention.

In the drawings, like numerals refer to like parts throughout the several views.

The apparatus of the present invention consists of a base frame 1 on which there are arranged a container receiving lock 2, a high pressure press 3 and a container discharge lock 4. Besides there are fastened to the base frame 1 lifting lugs 24. Furthermore, there can also be mounted rollers on the base frame 1.

Within the enclosure 7, there are located the container receiving lock 2, a part of the high pressure press 3, a compacting ram, a lift cylinder 5 in its one position reaches to a roller conveyor 10, and a container insertion device consisting of a hydraulic cylinder 6. There is advantageously attained a holding of a slightly reduced pressure of the enclosure 7 with the help of an exhaust fan 8 having the receiving filter 9 connected in series. Through this there is prevented the delivery of eventually contaminated air to the environment. The understructure of the apparatus of the present invention fastened on the base frame 1 is advantageously constructed with a collecting trough 12, especially for catching and collecting decontamination liquids which accumulate in the during washing and decontamination. The container to be compressed is a closed 200 liter sheet metal container 13, but can also be of other design. The sheet metal container 13 contains solid wastes, such as radioactively contaminated components, gloves, chemical toxic materials, in the form of pieces or also in loose bulk with correspondingly portions of empty volume. The sheet metal container 13 is placed on a roller conveyor 10 with a forklift truck or the like and is rolled until it is before the hydraulic cylinder 6 in the container receiving lock 2. Thereby the turnable container charging lock 2 is in the opened and loadable position from the outside, whereby the containment 7 remains sealed through the locked side lying opposite the lock inlet. Outside the containment 7 there is arranged a driving mechanism 25 for turning the lock.

Subsequently, the container receiving lock 2 with the sheet metal container 13 is turned around 180° so that the opening of the lock is opposite the high pressure press 3. Now the hydraulic cylinder 6 pushes the sheet metal container 13 under the pressing plunger (shown in broken lines) of the high pressure press 3. The high pressure press 3 is of known integral construction which is designed according to the use of the present invention. The hydraulic control unit of the press 3 besides the apparatus of the present invention is located outside the containment 7 and connected via couplers with the press. The press 3 is bolted with the base frame 1, likewise the press jacket by means of anchoring rods partially shown at 14.

After the pressing process, the shaped container 15, thus together with its waste crushed and compacted, formerly sheet metal container 13, is pushed out of the pressing position into a receiving position within the discharge lock area 4 below a movable gripping element 17. This is done by means of the hydraulic cylinder 5, which in its normal position is accommodated in the conveyor roller 10 divided by the lock 2 and is located within the container receiving lock 2 and first is raised slightly above the rollers 10 with the help of a lifting cylinder 11 into the necessary working position.

The gripping element 17 with its trilobe gripper, which is manipulated via a hydraulic cylinder 18, grips the crushed container 15, raises it by means of lifting cylinder 16 and positions it by means of a crane carriage 19 over a receiving container 27, for example, a 400 liter container. The gripping element 17 in some cases can also consists of an electromagnet.

The receiving container is tightly joined with the apparatus of the present invention via a vertically movable protective hood 20 which can be moved by means of hydraulic cylinder 21. The containment enclosure 7 closed on all sides thus in this manner is especially advantageously secure. After swinging aside a swinging plate 22 which is fastened to the protective hood 20, then the shaped container 15 can be inserted into the receiving container 27. After filling the receiving container 27 with the desired number of shaped containers 15 in each case the remaining empty volume in the receiving container 27 can be filled up with solidification agents. It is especially advantageous to provide the apparatus of the present invention with a conduit 26 for the supply of bitumen or hydraulically solidifying binder. It is possible therewith to fill up on the spot the empty volumes between the shaped containers 15 and the receiving container 27, for example, with concrete. It is especially favorable to arrange below the position of the receiving container 27 a vibrating machine 23 which effectively assists the trouble-free filling up of the empty volume.

After filling with shaped containers 15, the receiving container now serving as storage container and in a given case filling up the empty volume with concrete or the like, the swinging plate 22 is swung into its starting position. The now released storage container 27 is subsequently closed, raised by means of a forklift truck from the apparatus of the present invention and in a given case brought to a settling station and later into storage.

Figure 3:
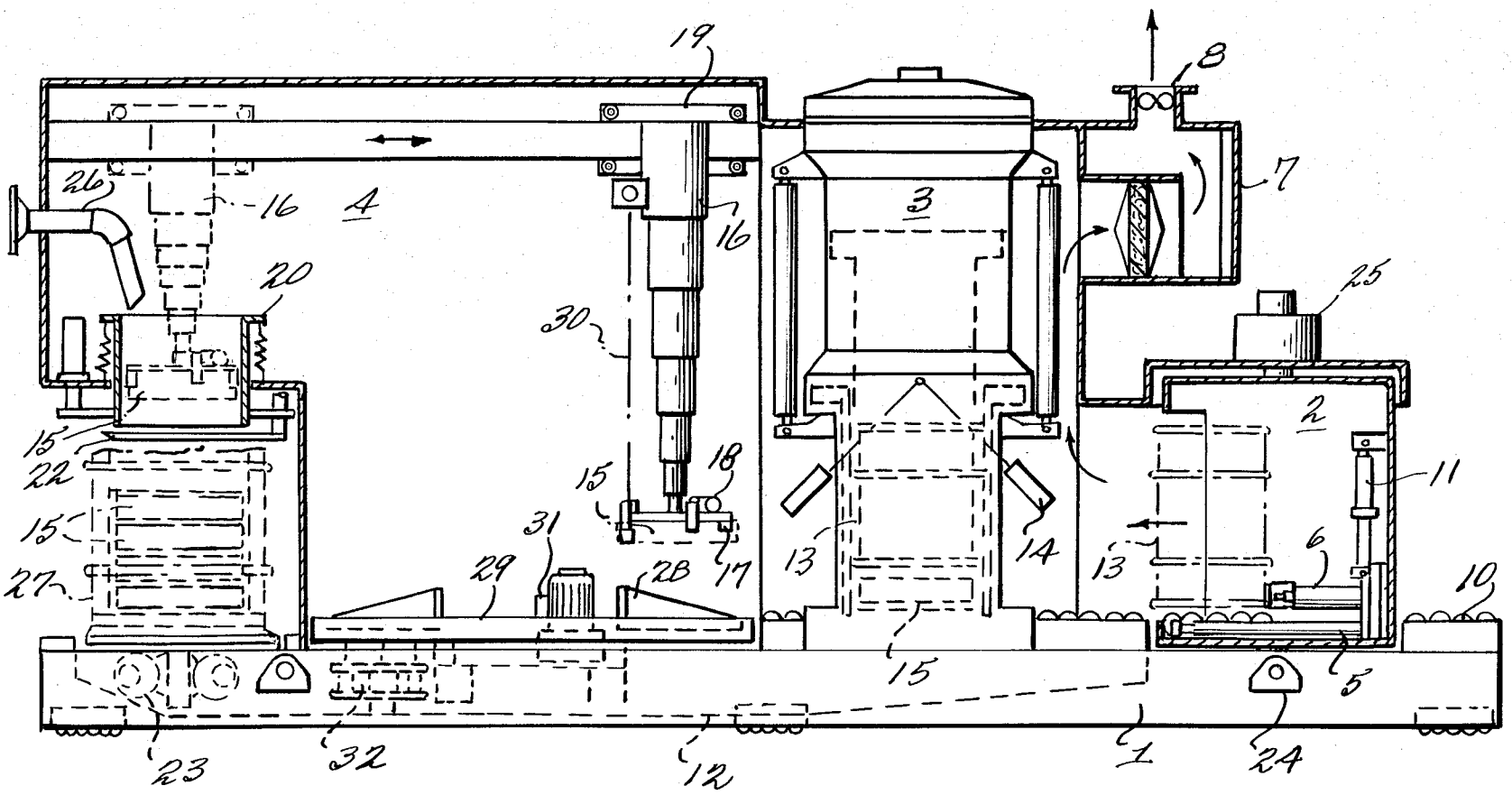
FIG. 3 shows still another advantageous form of the apparatus of the present invention.

There can be arranged a roller conveyor 28 below the gripping element 17. However, it has proven advantageous to mount a plate 29 at this place (see FIG. 3), which plate can be loaded with several shaped sheet metal containers 15. Through this it is possible via a height measuring apparatus 30 for the shaped container 15, a weighing apparatus 32 and a drive mechanism 31 for the turning plate to so select the containers 15 for the filling of the receiving container 27 that in each case an optimum filling occurs. A computer selects in each case those containers 15 which are needed for an optimum filling.

The apparatus of the present invention through its compact structure also is easily transportable, easily and safely manipulable from the outside through synchronized drives for the sequence of operation and through possibly mutually interlocking important functions as, e.g., manipulating locks, presses and concrete supply.

What is claimed is:

1. An apparatus for compacting solid bioinjurious waste in closed containers comprising in combination a closed containment means having roller conveyor means, a container receiving means which is rotatable about a vertical axis, a high pressure press, a container discharge lock means with a receiving chamber, a first hydraulic cylinder means within said receiving means for transporting the container into the high pressure press and said receiving means being provided with a second liftable hydraulic cylinder means lying under the roller conveying means when located in one position and, when lifted to a second position, extendable in the direction of said high pressure press to eject the shaped container from the high pressure press, and a movable gripping means for engaging and moving the shaped container to the container discharge lock means.

2. An apparatus according to claim 1 including collecting trough means located below said containment means.

3. An apparatus according to claim 1 wherein the container discharge lock means contains above the receiving chamber protective hood means and hydraulic cylinder means for moving the protective hood means vertically.

4. An apparatus according to claim 1 including jolting means below the receiving chamber adapted to and in filling up the empty volume in the receiving container.

5. An apparatus according to claim 1 including turnable plate means below the gripping means.

6. An apparatus for compacting according to claim 1 including conduit means within the containment means for supplying a solidification agent into said receiving chamber.

7. An apparatus according to claim 6 including collecting trough means located below said containment means.

8. An apparatus according to claim 1 including ventilating fan means and filter means arranged on the containment means.

9. An apparatus according to claim 8 including collecting trough means located below said containment means.

10. An apparatus according to claim 9 wherein the container discharge lock means contains above the receiving chamber protective hood means and hydraulic cylinder means for moving the protective hood means vertically.

11. An apparatus according to claim 9 including jolting means below the receiving chamber adapted to and in filling up the empty volume in the receiving container.

12. An apparatus according to claim 9 including turnable plate means below the gripping means.

13. An apparatus according to claim 6 including ventilating fan means and filter means arranged on the containment means.

14. An apparatus according to claim 13 including collecting trough means located below said containment means.

15. An apparatus according to claim 14 wherein the container discharge lock means contains above the receiving chamber protective hood means and hydraulic cylinder means for moving the protective hood means vertically.

16. An apparatus according to claim 15 including jolting means below the receiving chamber adapted to aid in filling up the empty volume in the receiving container.

17. An apparatus according to claim 16 including turnable plate means below the gripping means.

* * * * *